US011174701B2

(12) United States Patent
Pearl, Jr. et al.

(10) Patent No.: US 11,174,701 B2
(45) Date of Patent: Nov. 16, 2021

(54) WELLBORE REMEDIAL OPERATIONS WITH NO-HEAT LIQUID SOLDER

(71) Applicant: Halliburton Energy Services, Inc., Houston, TX (US)

(72) Inventors: William Cecil Pearl, Jr., Spring, TX (US); Samuel J. Lewis, Spring, TX (US); Frank Vinicia Acosta Villarreal, Spring, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/746,469

(22) Filed: Jan. 17, 2020

(65) Prior Publication Data

US 2021/0222512 A1 Jul. 22, 2021

(51) Int. Cl.
*E21B 33/138* (2006.01)
*E21B 43/00* (2006.01)
*E21B 1/00* (2006.01)

(52) U.S. Cl.
CPC ..... *E21B 33/138* (2013.01); *E21B 1/00* (2013.01)

(58) Field of Classification Search
None
See application file for complete search history.

(56) References Cited

U.S. PATENT DOCUMENTS 10,266,925 B2 4/2019 Thuo et al.
2003/0058127 A1 3/2003 Babour et al.
2004/0007389 A1* 1/2004 Zupanick ..... E21B 7/061 175/61
2004/0104045 A1 6/2004 Larovere
2006/0037748 A1 2/2006 Wardlaw et al.
2009/0229494 A1 9/2009 Shah et al.
2012/0247765 A1 10/2012 Agrawal et al.
2016/0137912 A1 5/2016 Sherman et al.
2016/0258269 A1 9/2016 Musso et al.
2017/0014958 A1* 1/2017 Thou ..... B23K 35/3013
2017/0081956 A1 3/2017 Ganguly et al.
2017/0107419 A1* 4/2017 Roy ..... C22C 1/0416
2018/0258735 A1 9/2018 Shafer
2018/0274333 A1 9/2018 Gibb

FOREIGN PATENT DOCUMENTS

WO 2017011029 1/2017

OTHER PUBLICATIONS

PCT Application No. PCT/US2020/014155 , International Search Report and Written Opinion, dated Oct. 7, 2020, 12 pages.
PCT Application No. PCT/US2020/014159 , International Search Report and Written Opinion, dated Oct. 7, 2020, 13 pages.
PCT Application No. PCT/US2020/014161 , International Search Report and Written Opinion, dated Oct. 15, 2020, 12 pages.
(Continued)

*Primary Examiner* — Charles R Nold
(74) *Attorney, Agent, or Firm* — Kilpatrick Townsend & Stockton LLP

(57) ABSTRACT

Remedial wellbore operations can be performed using metal material coated with a layer that is controllably activated to release the metal material downhole in a wellbore. At least a portion of the wellbore can be plugged or sealed using the metal material.

20 Claims, 7 Drawing Sheets

(56) References Cited

OTHER PUBLICATIONS

PCT Application No. PCT/US2020/014164 , International Search Report and Written Opinion, dated Oct. 15, 2020, 12 pages.
Cinar et al., "Mechanical Fracturing of Core-Shell Undercooled Metal Particles for Heat-Free Soldering", Scientific Reports, www.nature.com/scienfificreports, 6:21864, Feb. 23, 2016, 12 pages.

* cited by examiner

WELLBORE REMEDIAL OPERATIONS WITH NO-HEAT LIQUID SOLDER

TECHNICAL FIELD

The present disclosure relates generally to materials usable in a wellbore environment for remedial processes. More specifically, this disclosure relates to use of metal material that can be controllably released in the liquid state to form solid metal seals.

BACKGROUND

During completion of a well in a subterranean formation, casing may be added to the wellbore and cemented to seal and fix the casing in the wellbore. In some cases, damage can occur to the casing and cement and repairs or patches to seal the damaged casing or cement can be undertaken.

Perforations in the casing, cement, and formation may also be introduced during completion to enable efficient production of hydrocarbons from the formation. In some cases, the perforations may be undesired and so sealing or closing the perforations can be performed.

DETAILED DESCRIPTION

Figure 1:
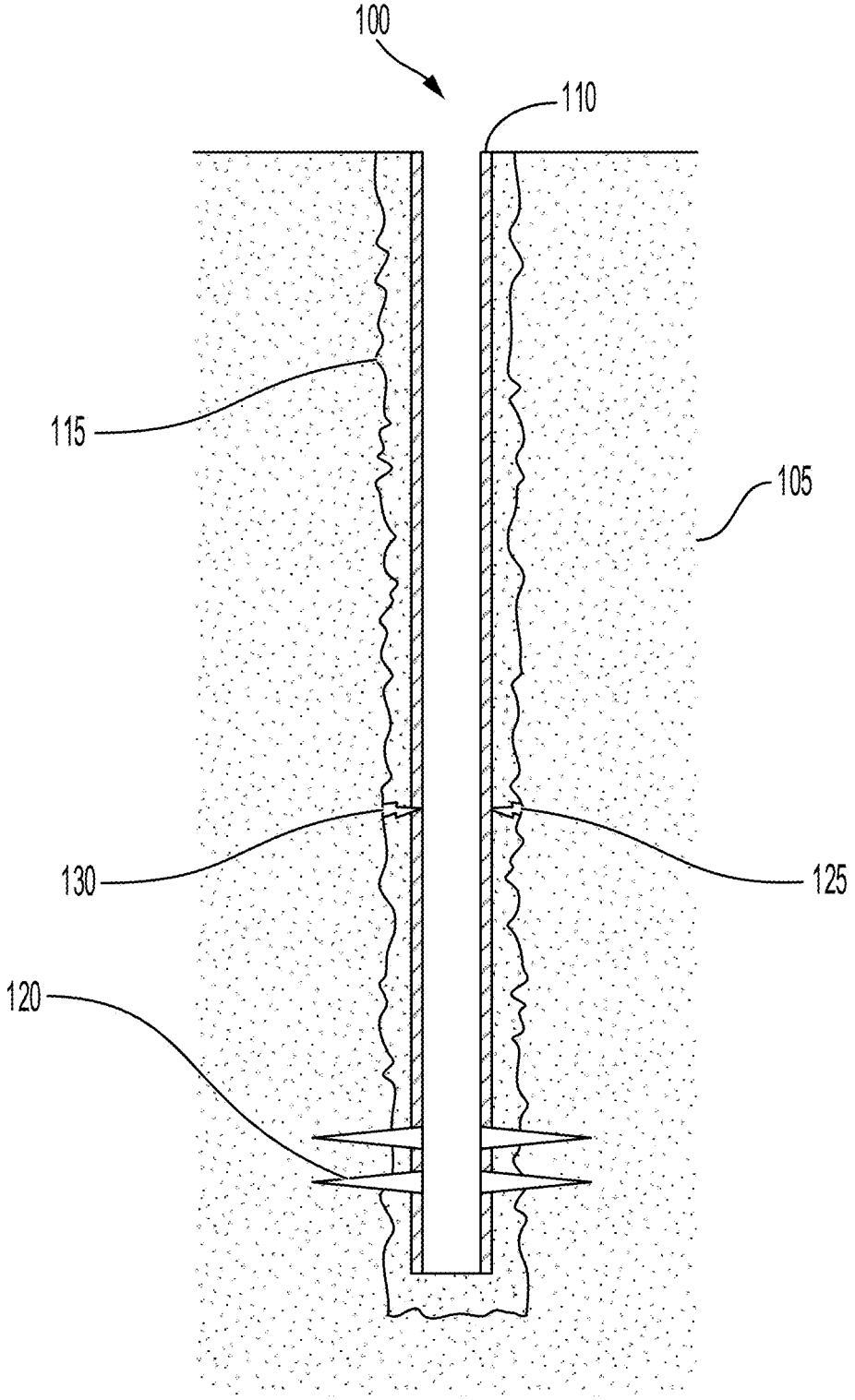
FIG. 1 is a schematic illustration depicting a wellbore for performance of one or more remedial operations according to one example of the present disclosure.

Certain aspects and examples of the present disclosure relate to remediation of a wellbore using a metal material coated with a layer allowing controlled activation to release the metal material within the wellbore. In some embodiments, the metal material may be positioned downhole in the wellbore and activated to perform a wellbore completion operation, such as a remedial operation. Wellbore remediation may include processes associated with repairing downhole damage or repairing leaks in a wellbore or closing unwanted perforations with a metal seal, for example. The metal material may comprise a metal or alloy that is in the liquid state prior to activation. The metal material may exist in an undercooled (sometimes referred to as a supercooled) liquid state because the presence of the coating layer can stabilize the metal material in the liquid state below its freezing/melting point. The layer can be controllably activated by breaking, dissolving, or otherwise disrupting the layer to allow the undercooled metal material in the liquid state to be released, after which it can solidify. Example techniques for activating the layer include, but are not limited to subjecting the layer to heat, ultrasonic energy, a magnetic field, an electric field, a compressive stress, a shear stress, or a chemical dissolution treatment.

Use of metal material coated with a layer that is controllably activated in a wellbore remedial operation can avoid the use of high temperature or complex repair operations, such as using thermite or electrical arc welding for repairs. As an example, the metal material can be applied at the location needed for remedial operations and the coating layer activated under ambient temperature conditions to release liquid metal material that solidifies to create a solid metal seal.

The metal material coated with a layer that is controllably activated can be used for patching casing in a wellbore, such as to repair leaks, seal damage, or for other downhole repairs. The metal material coated with the layer can be applied directly onto damaged casing or other objects and activated immediately to apply liquid metal material that solidifies to fill in gaps, cracks, or voids within the damaged casing. In some cases, the metal material may be included in a mixture comprising a carrier fluid, such as a suspension of particles of the metal material in a carrier fluid. Particles of the metal material may have any suitable sizes, such as a diameter of from 3 nm to 10 μm, or any value within this range. In some cases, the activation of the layer can be performed after the metal material coated with the layer is placed onto the damaged casing or other object, such as within gaps, cracks, or voids, such as by subjecting the metal material coated with the layer to a physical or chemical activation process, among others. In some cases, the act of applying the metal material onto the damaged casing or other object can initiate activation of the layer. For example, by spraying the metal material coated with the layer through a spray nozzle, the pressures and forces exerted on the layer during spraying can cause the layer to activate, such as by physically rupturing the layer, resulting in liquid metal material being applied directly to the damaged casing or other object, which can rapidly solidify to form a patch or other repair to the damage.

The metal material coated with a layer can also or alternatively be useful for closing unwanted perforations in a wellbore, such as to seal zones within a subterranean formation containing water or to generally seal perforations as desired with a metal seal. For example, the metal material coated with the layer can be applied to perforations and the layer can be activated to release liquid metal material that solidifies to fill the perforations with solid metal material. Activating the layer can again comprise physical or chemical activation processes, among others. In some cases, when the metal material coated with the layer is applied to the perforation, pressure differentials can subject the layer to stress, resulting in activation to release liquid metal material that solidifies to form a solid metal seal.

In some cases, the metal material coated with the layer can be used for a squeeze job, such as in place of or in addition to a cement slurry. Such a configuration can be used to repair a primary cement, to repair casing, or to fill unwanted perforations by forcing the metal material through holes in the casing to create a solid metal seal in the casing-wellbore annulus. Depending on the structure of the well, packers or plugs may be used above or below the location of the squeeze job to isolate the squeeze job from adjacent zones. In some cases, an activation mechanism may be included at the downhole location of the squeeze job to activate the layer and release the metal material. For example, an ultrasonic transducer, heater, or electromagnet can be included at the downhole location for activating the layer. In some cases, the process of squeezing the metal material to force it through perforations, gaps, cracks, or other openings can activate the layer to release metal material as it passes from within the casing to outside the casing or through the casing. As another example, a pressure differential at the location of a leak can apply forces on the layer to cause it to activate. Upon activation of the layer, the metal material can be released in liquid form, where it can flow to and fill in and seal the perforation, gap, leak, etc. as it solidifies.

In another example, the metal material coated with the layer may be used as a remedial strategy for well control. As noted above, the metal material coated with the layer can be used for closing unwanted perforations, which can provide for well control in some embodiments. As another example, the metal material can be used to form a kill pill or other high density or solid metal slug or plug that can be positioned in the wellbore to control or seal the well. In some cases, the solid metal slug or plug can be used to control loss zones.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic illustration depicting a wellbore 100. Wellbore 100 can extend through various earth strata and can extend through or into a hydrocarbon bearing subterranean formation 105. Although wellbore 100 is depicted in FIG. 1 as substantially vertical, other orientations for sections of wellbore 100 can be used, including curved, angled, or substantially horizontal. Wellbore 100 includes a casing string 110. Cement 115 is used to fix casing string 110 in place within the wellbore. Other commonly used components may be included to fix casing string 110 within the wellbore, but are not depicted in FIG. 1 so as not to obscure other details. Perforations 120 are also shown in FIG. 1 as openings extending through casing string 110, through cement 115 and into formation 105. Damage 125 is shown to cement 115 and damage 130 is shown to both cement 115 and casing string 110. To seal damage 125 or 130, remedial operations can be used to at least partially fill or seal damage 125 or 130 with metal material, such as by applying to the damage 125 or 130 metal material coated with a layer that is controllably activated and activating the layer. To fill or seal one or more of perforations 120, metal material coated with a layer that is controllably activated can be placed within the perforations 120 and the layer can be activated to release the metal material.

Figure 2:
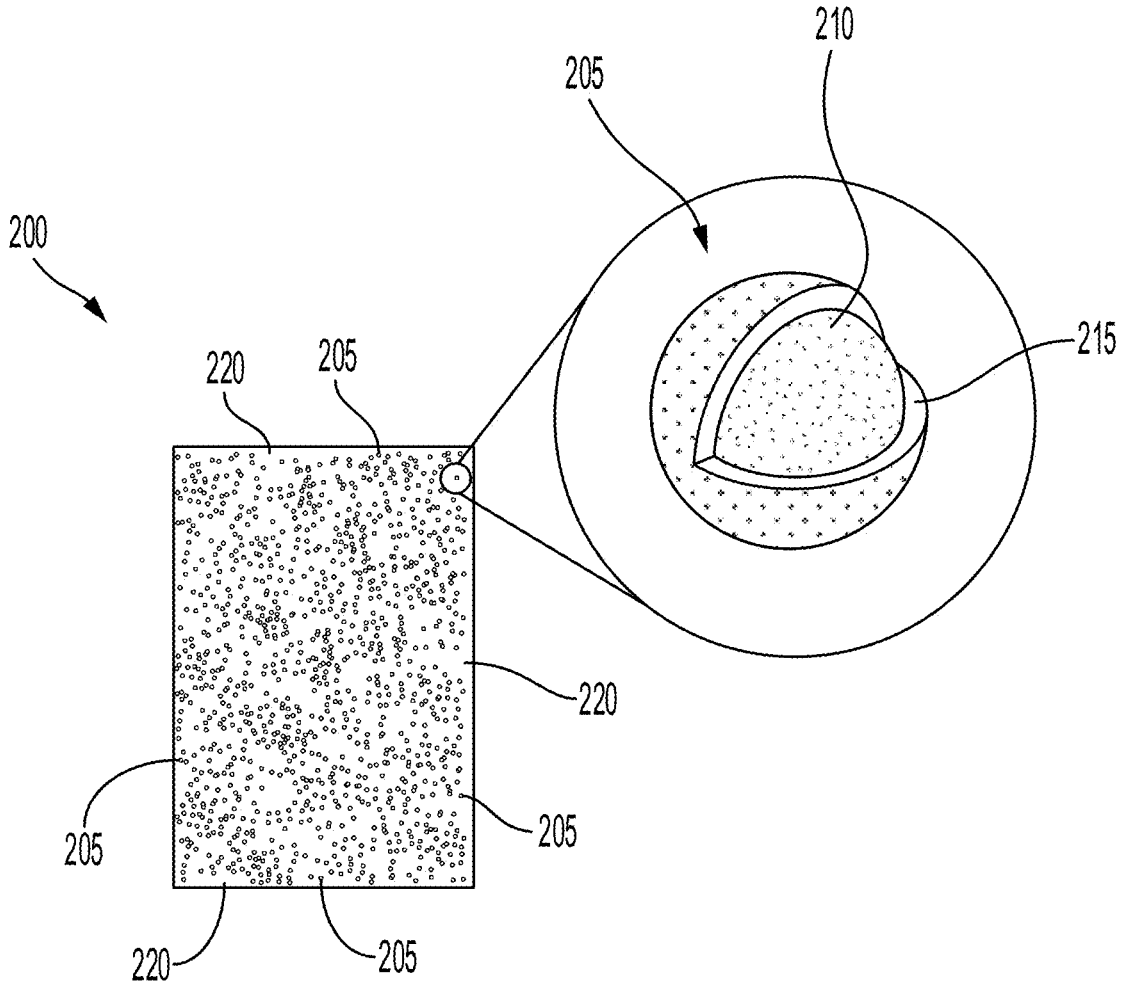
FIG. 2 is a schematic illustration of a mixture comprising a metal material according to one example of the present disclosure.

FIG. 2 is a schematic illustration of a mixture 200 comprising particles 205 of a metal material 210 according some examples of the present disclosure. Particles 205 may be described as having a core-shell particle structure with metal material 210 corresponding to a core and a layer 215 corresponding to a shell. The particles 205 of metal material 210 may be dispersed in, suspended in, or otherwise supported by a carrier fluid 220, which can be a wellbore treatment material. Metal material 210 may comprise a metal or alloy, in an undercooled liquid state, meaning that the metal material 210 in the particles 205 is a liquid, but is present at a temperature below the melting or solidus temperature of the metal material 210. Any suitable metal or alloy may be useful as the metal material 210, such as those metals or alloys having a melting or solidus temperature of less than about 100° C., less than about 200° C., or less than about 300° C. Optionally, a useful metal or alloy has a melting or solidus temperature greater than the temperature of a subterranean formation. In some examples, useful alloys include, but are not limited to, solder alloys, Field's metal (a eutectic alloy of bismuth, indium, and tin), Wood's metal (a eutectic alloy of bismuth, lead, tin, and cadmium), Cerrosafe (an alloy of bismuth, lead, tin, and cadmium), and Rose's metal (an alloy of bismuth, lead, and tin). Other alloys may be used, such as alloys comprising, consisting of, or consisting essentially of one or more of bismuth, lead, tin, indium, cadmium, thallium, gallium, zinc, copper, silver, gold, or antimony. Eutectic alloys comprising one or more of bismuth, lead, tin, indium, cadmium, thallium, gallium, zinc, copper, silver, gold, or antimony may also be used. Metals and alloys with melting temperatures as high as 500° C. can be used in some embodiments.

As shown in the inset in FIG. 2, the particles 205 of the metal material 210 may include a layer 215, which is schematically depicted in a partial cutaway view to show metal material 210 within layer 215. Layer 215 may be used as a stabilization layer or provide a stabilization effect, allowing metal material 210 to exist in the liquid state at temperatures below a melting or solidus temperature of metal material 210. Layer 215 may comprise one or more of a metal oxide, a chelated stabilizer, an organic adlayer, an inorganic adlayer, or an organic functional group. Example adlayers or functional groups that may be present on a surface of layer 215 may comprise acetate or phosphate. A specific example of layer 215 may comprise a metal oxide, such an oxide of the metal or alloy comprising the metal material 210 (e.g., a self-passivating oxide layer), optionally formed in-situ on the liquid metal material 210. The layer may include a chelated organic stabilizer on the surface thereof, such as a chelated acetate outer shell layer.

Particles of a metal material coated with such a layer may be generated by using a metal droplet emulsion technique. As an example, an amount of a liquid metal at a temperature above its melting or solidus point can be immersed in a dilute acid solution, such as a solution of ~2-5% acetic acid in diethylene glycol, and a rotating implement can be inserted into the mixture and rotated to generate a shearing force that separates small droplets, corresponding to particles 205, of the liquid metal which are coated with an oxide layer with a chelated stabilizing layer. The oxide layer and chelated stabilizing layer can serve to isolate the liquid metal from contacting nucleation sites, trapping the liquid metal in a metastable liquid state. Metals with higher melting temperatures can be used when the solution has suitable properties so that the solution stays in liquid form at the melting temperature of the metal. As examples, polyphenyl ether pump fluid or a variety of ionic liquids can be used, as these materials can have boiling temperatures as high as 500° C. or more. The resultant particles 205 can have any suitable dimensions. For example, particles 205 can have a diameter of from 3 nm to 10 μm, or any value within this range. Optionally, the particles 205 can be removed from the emulsion and concentrated to create large volumes of metal material in the form of particles 205. Optionally, the particles 205 can be suspended or dispersed in carrier fluid 220, which may be the same as the solution in which the particles 205 are created or may be a different fluid.

The layer 215, such as an oxide layer and chelated stabilizing layer, can be controllably activated to allow the metal material 210 inside to be controllably released in a liquid state, from which the metal material 210 can flow and then undergo a transformation to a solid state. Activation of layer 215 may include subjecting layer 215 to conditions that disrupt the oxide or chelated stabilizer, such as through mechanical or physical disruption or chemical or other dissolution. Example techniques for activating or controllably activating layer 215 include, but are not limited to, subjecting layer 215 to heat, ultrasonic energy, a magnetic field, an electric field, a compressive stress, a shear stress, or a chemical dissolution treatment. Advantageously, activation of layer 215 does not require the use of heat to allow metal material 210 to be in the liquid state upon activation, though heat may optionally be used to activate layer 215. Stated another way, since metal material 210 is already in the liquid state within layer 215, by disrupting layer 215, metal material 210 can be released in a liquid state without using heat to melt metal material 210 from a solid state to a liquid state. Further, layer 215 can be activated under ambient conditions or conditions within a wellbore or a formation, to release the metal material 210 in the liquid state.

Mixture 200 may also comprise a carrier fluid 220. For example, carrier fluid 220 may optionally comprise the continuous phase of the emulsion in which the particles 205 are created (e.g., a solution comprising ethylene glycol, an ionic liquid, a polyphenyl ether pump fluid) or another solvent (e.g., water, ethanol, methanol, a liquid hydrocarbon, etc.). Optionally, carrier fluid 220 is itself a mixture. For use in downhole operations in a wellbore, carrier fluid may optionally comprise, for example, an uncured cement or cement slurry, an uncured resin, an uncured polymeric material, a polymer precursor, a drilling mud, a spacer fluid, lost-circulation material, oil-based mud, water-based mud, or the like. Some carrier fluids may cure, change form, or otherwise change state as a function of time, such as curing of a cement to form cured cement, curing of a resin to form cured resin, or curing of a polymeric material or polymerization of a polymer precursor to form a cured polymeric material. In some cases, carrier fluid 220 may facilitate the activation of layer 215, such as by transferring heat, applying stress or strain, or transferring ultrasonic energy, for example.

A concentration of the metal material 210 or particles 205 in mixture 200 may vary depending on the particular application, and concentrations of from 5% by weight to 95% by weight may be used. Other example concentrations (percent by weight) of metal material 210 or particles 205 in mixture 200 include, but are not limited to, about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, from 10% to 90%, from 10% to 40%, from 60% to 90%, etc.

In some cases, metal material 210 or particles 205 may settle out of carrier fluid 220, such as over time due to gravity. Metal material 210 or particles 205 may have a density or specific gravity that is higher than that of carrier fluid 220. In such a case, the mixture 200 can have an overall density or specific gravity that is higher than the carrier fluid without metal material 210 or particles 205. In some examples, a specific gravity for mixture 200 may range from 3 to 12. The specific gravity for mixture 200 can be a function of the composition of metal material 210, the composition of carrier fluid 220, and the concentration of metal material 210 in carrier fluid 220, for example.

Figure 3:
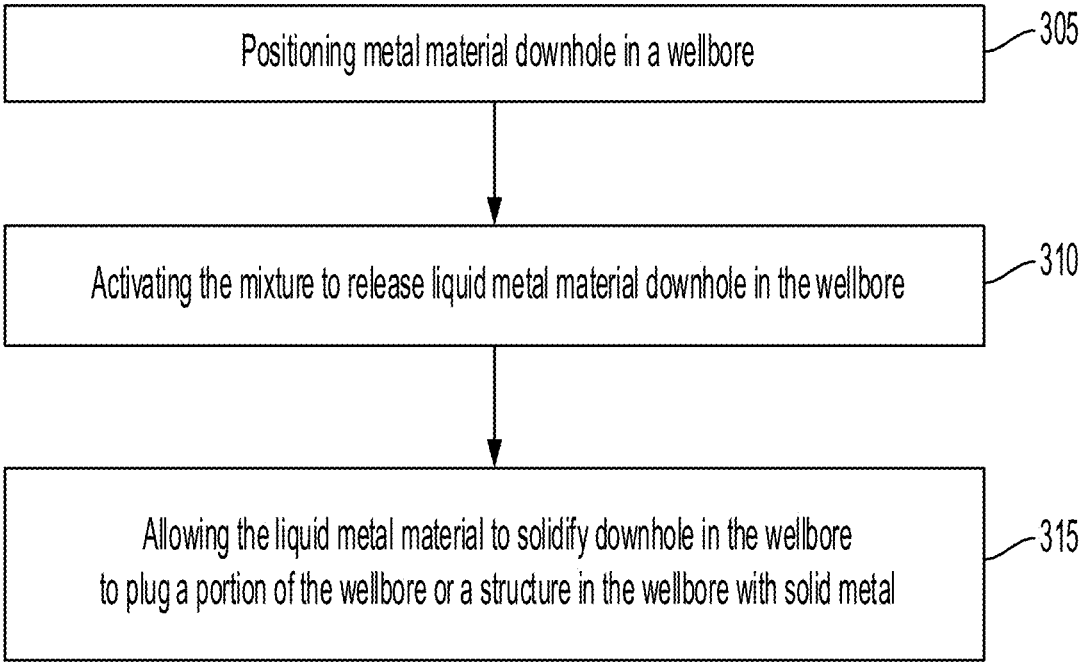
FIG. 3 is a flowchart providing an overview of an example of a method according to the present disclosure.

FIG. 3 is a flowchart providing an overview of an example method according to the present disclosure, such as a method for performing a wellbore remedial operation. At block 305, a metal material coated with a layer is positioned downhole in a wellbore. The metal material may optionally comprise any of the mixtures described herein, such as mixture 200. The metal material may comprise any metal material described herein, such as metal material 210. The metal material may be in the form of or comprise particles, such as particles 205 in which metal material 210 is coated with layer 215. The metal material coated with the layer may be in a liquid state prior to being positioned downhole in the wellbore. The metal material may be dispersed or suspended in a carrier fluid for positioning the metal material downhole in the wellbore.

At block 310, the layer can be activated to release the metal material in a liquid state downhole in the wellbore. Activation of the layer can be useful for performing, or assisting the metal material in performing, a wellbore treatment or completion operation, such as a wellbore remedial operation. Non-limiting examples of activating the layer include subjecting the metal material to one or more of heat, ultrasonic energy, magnetic fields, electric fields, compressive stress, shear stress, or chemical dissolution treatment.

At block 315, the metal material is allowed to solidify downhole in the wellbore to plug a portion of the wellbore or a structure in the wellbore, such as a casing or cement in the wellbore, with solid metal. As described above, the layer may allow the metal material to exist in a supercooled or undercooled condition in the mixture; that is, the metal material can be in a liquid form even though its temperature is less than the metal material's melting or solidus temperature. Upon activating the layer and releasing the metal material, the metal material can flow, in liquid form, for an amount of time and then the metal material may solidify, such as upon the metal material contacting another substance or object, which may initiate crystallization of the metal material in solid form.

Non-limiting uses of the metal material in the solid state may include those described above. For example, activation of the layer can be useful for patching, sealing, or repairing damage downhole in the wellbore, such as by allowing the metal material to fill voids, cracks, or leaks, such as in the casing or the primary casing cement. Optionally, the metal material may be used to fill or close unwanted perforations in the wellbore, such as to seal water zones. In such a case, the metal material may optionally extend from the wellbore into the formation. Optionally, the metal material may be used to create an annular barrier, such as a barrier lining the circumference within a casing or as a barrier in the annular spacing between the casing and the wellbore. Optionally, the metal material can be used as a component or in place of other material (e.g., a cement slurry) used in a squeeze job or as a kill pill or other solid metal plug used for well control or to fill or seal loss zones.

Figure 4:
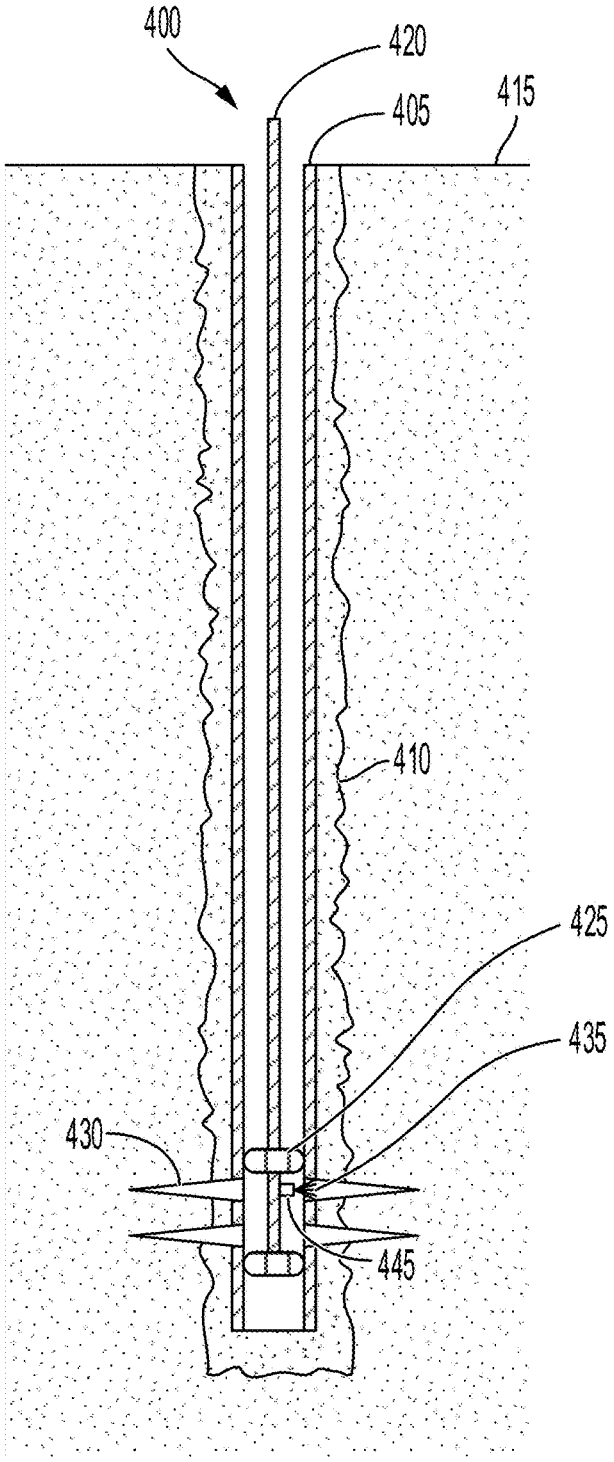
FIG. 4 is a schematic illustration depicting a remedial operation plugging of a perforation in a wellbore according to one example of the present disclosure.

FIG. 4 is a schematic illustration depicting a remedial operation plugging of a perforation in a wellbore according to one example of the present disclosure. FIG. 4 shows a wellbore 400 with a casing string 405 and cement 410 in a formation 415. A wellbore treatment string 420 is positioned downhole in wellbore 400 and is positioned between packers or plugs 425 to isolate perforations 430, though packers or plugs 425 are optional. Here, perforations 430 are undesirable and so a remedial operation is in process for sealing the perforations.

The remedial operation includes applying metal material 435 with a layer that is controllably activated to one or more of the perforations 430 and activating the layer to release the metal material in liquid form at the perforations 430. Any suitable technique for applying metal material 435 to the perforations 430 may be used. Any suitable technique for activating the layer may be also used.

Figure 5:
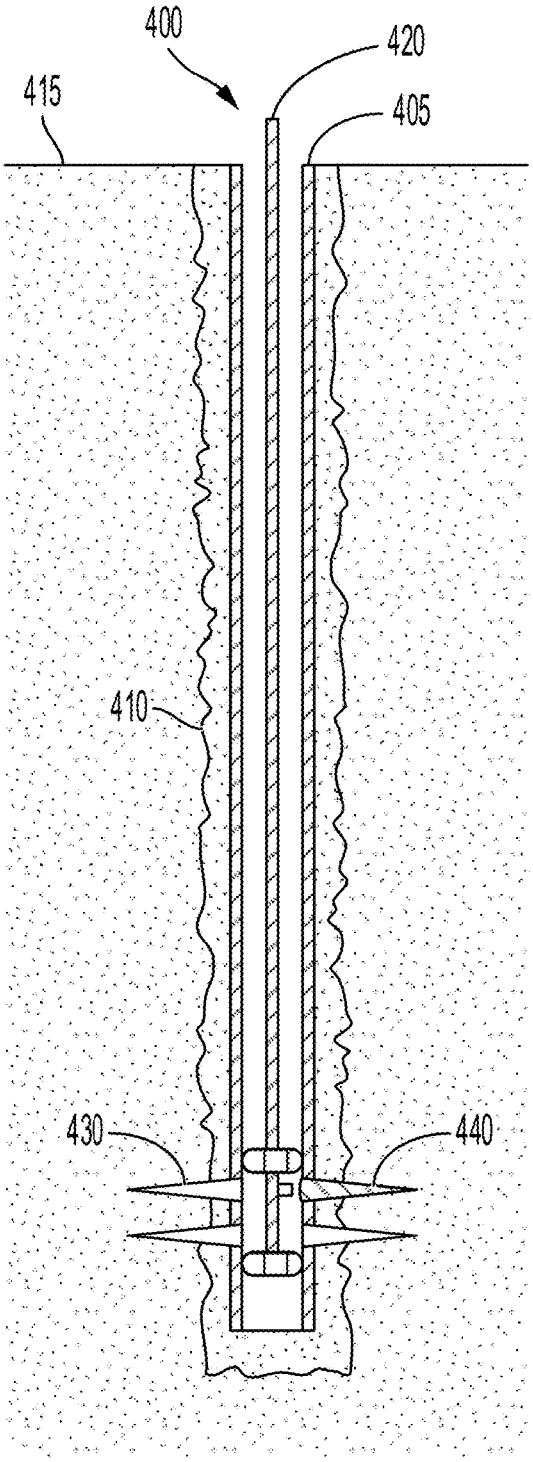
FIG. 5 is a schematic illustration depicting a sealed perforation in a wellbore according to one example of the present disclosure.

In FIG. 4, the metal material 435 is applied using a nozzle 445, such as a spray nozzle, which can optionally serve to both position the metal material 435 at the desired location and activate the layer to release metal material in a liquid state at the same time. Although only one nozzle 445 is shown for applying metal material any suitable number for metal material delivery devices may be used. As another example, the metal material may be applied using one or more fluid outlets from wellbore treatment string 420 and a heater, electromagnet, or ultrasonic transducer to apply heat, a magnetic field, or ultrasonic energy to metal material 435 to activate the layer. FIG. 5 is a schematic illustration depicting wellbore 400 with a casing string 405 and cement 410 in a formation 415 after filling a first perforation 430 with solid metal material 440. Although only one perforation 430 is shown as filled or sealed with solid metal material, other configurations and components of wellbore treatment string 420 can fill or seal perforations 430 simultaneously. Perforations 430 can optionally be filled or sealed sequentially.

Figure 6:
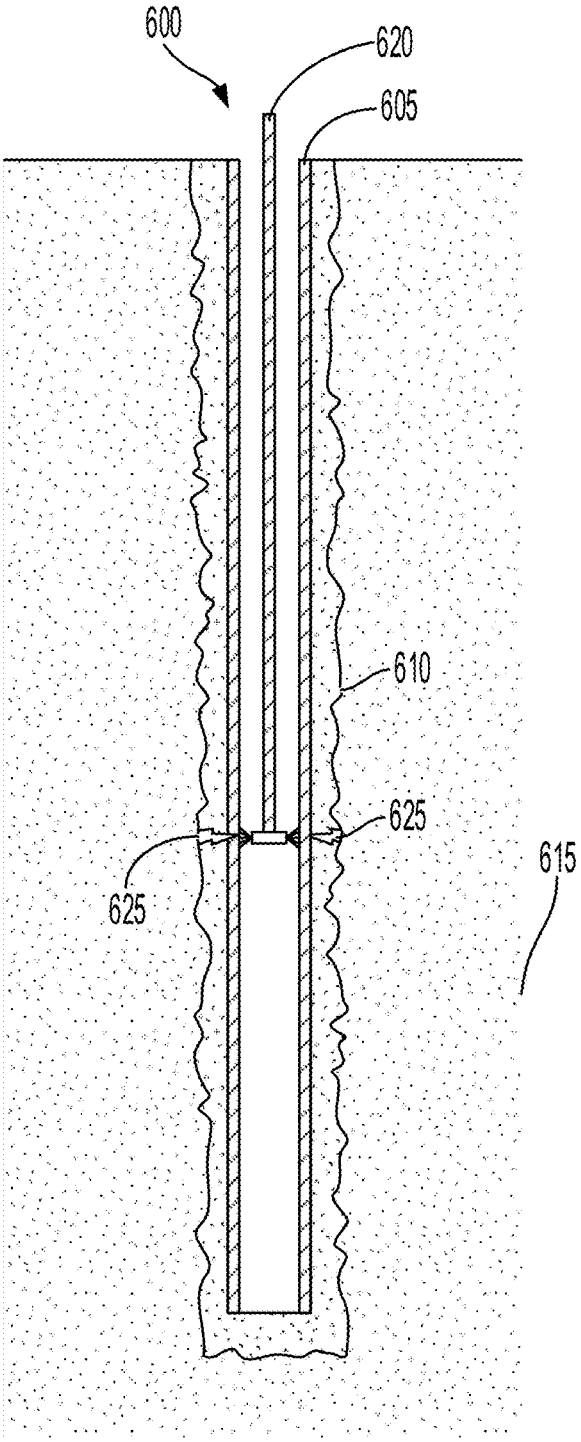
FIG. 6 is a schematic illustration depicting a remedial operation repairing damage to casing and cement in a wellbore according to one example of the present disclosure.

FIG. 6 is a schematic illustration depicting a remedial operation repairing damage to casing and primary casing cement in a wellbore according to one example of the present disclosure. FIG. 6 shows a wellbore 600 with a casing string 605 and cement 610 in a formation 615. A wellbore treatment string 620 is positioned downhole in wellbore 600 and is positioned for a remedial operation of patching damage 625 to casing string 605 and cement 610. Although no packers or plugs are shown in FIG. 6 for isolating the damage 625, packers or plugs may be optionally used. As an example, damage 625 is shown extending through both casing string 605 and cement 610 at certain positions and only though cement 610 at other positions.

The remedial operation includes applying metal material 630 with a layer that is controllably activated to the casing at the location of damage 625 and activating the layer to release the metal material in liquid form at the casing, at which the liquid metal material may solidify and form a patch 635. Any suitable technique for applying metal material 435 to the casing string 605 may be used. Any suitable technique for activating the layer may be also used.

For example, in FIG. 6, the metal material 630 is applied using a circumferential applicator nozzle, which can optionally serve to both position the metal material 630 at its desired location and activate the layer and release liquid metal material at the same time. Although the nozzle is depicted as circumferentially applying metal material 630, other configurations are contemplated, such as where a stream of the metal material 630 is directed around 360° or less by rotating the source nozzle. As another example, the metal material may be applied using one or more fluid outlets from wellbore treatment string 620 and a heater, electromagnet, or ultrasonic transducer of wellbore treatment string 620 may be used to apply heat, a magnetic field, or ultrasonic energy to metal material 630 to activate the layer.

Figure 7:
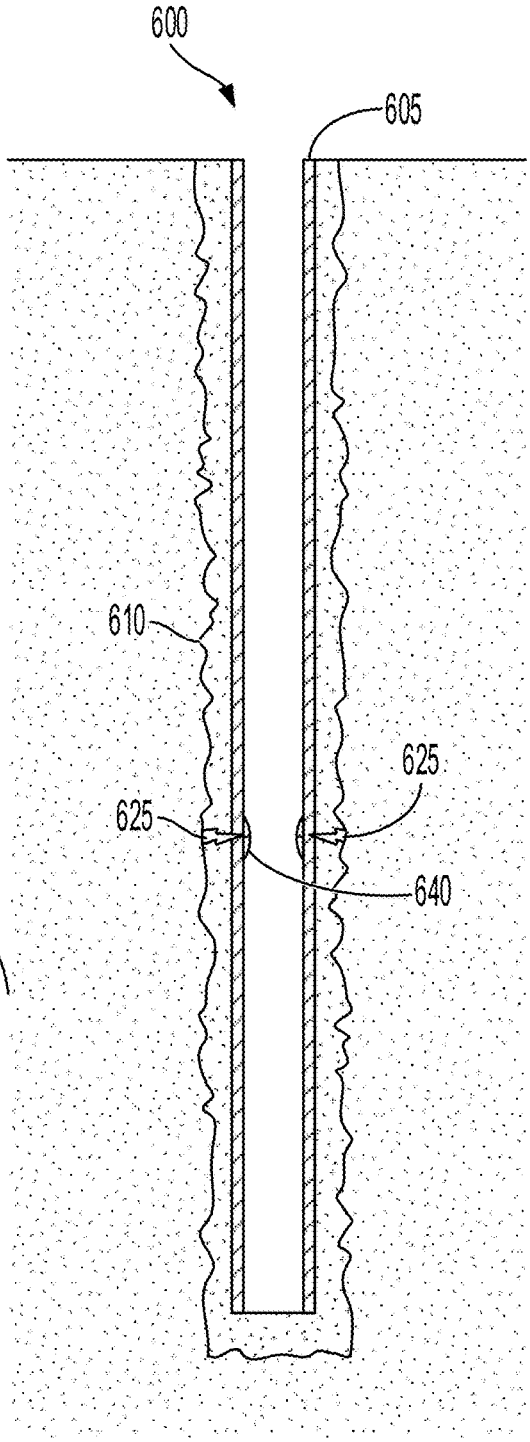
FIG. 7 is a schematic illustration depicting sealed damage in a wellbore according to one example of the present disclosure.

FIG. 7 is a schematic illustration depicting wellbore 600 with a casing string 605 and cement 610 in a formation 615 after applying metal material as a casing patch 640 comprising solid metal material. Although casing patch 640 is shown as circumferentially sealing the casing string 605, casing patch 640 may seal only a subset of the inner circumference of casing string 605. Additionally, casing patch 640 is shown as extending into cement 610 at the location where both the casing string 605 and cement 610 include damage 625. Casing patch 640 can serve to strengthen casing string 605 against further damage.

Figure 8:
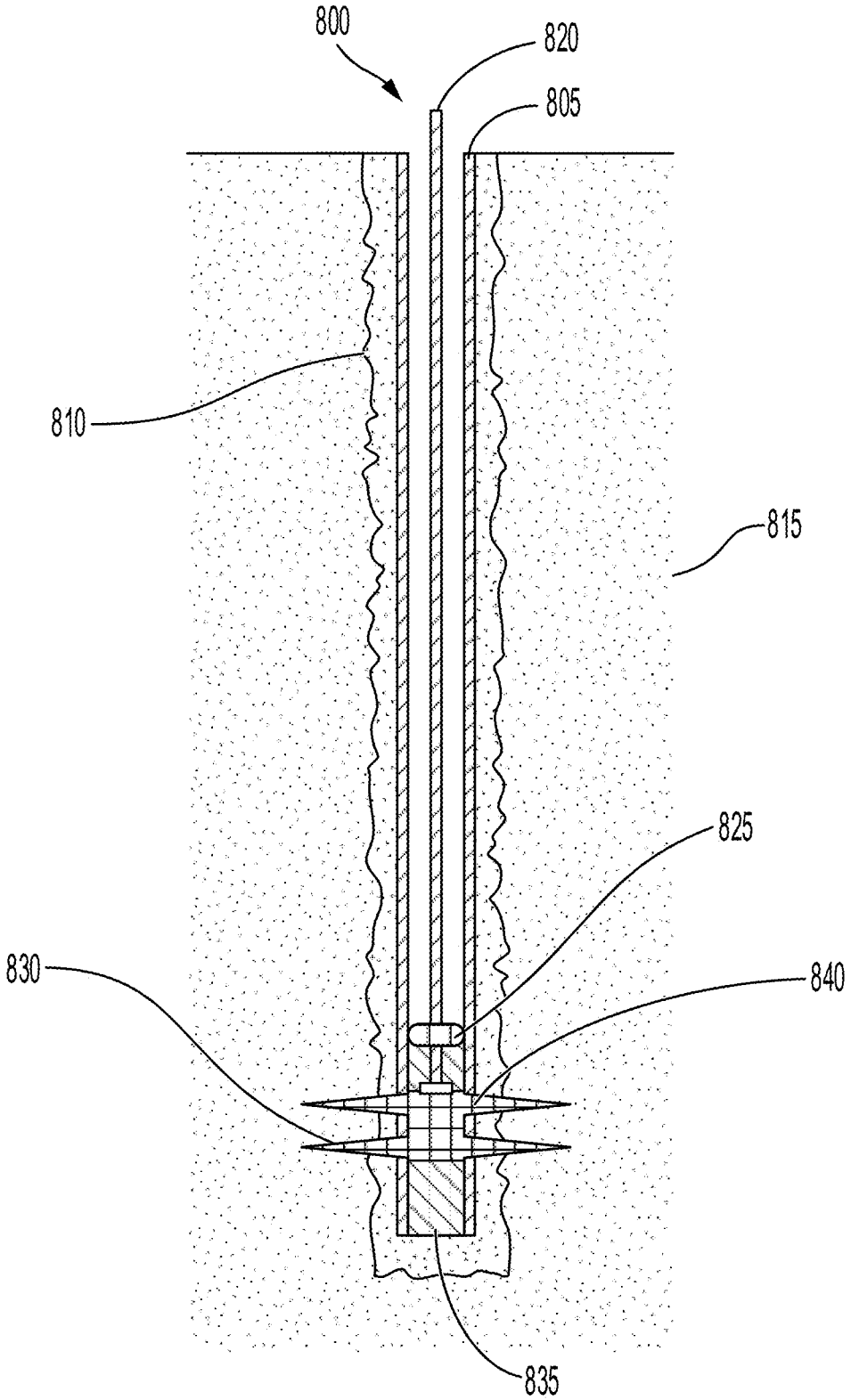
FIG. 8 is a schematic illustration of a wellbore in which a solid metal plug is used for well control according to one example of the present disclosure.

FIG. 8 is a schematic illustration of a wellbore in which a solid metal plug is used for well control according to one example of the present disclosure. FIG. 8 shows a wellbore 800 with a casing string 805 and cement 810 in a formation 815. A wellbore treatment string 820 is positioned downhole in wellbore 400 and includes a packer or plug 825 to isolate perforations 830, though packer or plug 825 is optional. Here, wellbore treatment string 820 delivers metal material 835 having a controllably activated coating layer to bottom of casing string 805 for a squeeze job in which the metal material is forced into perforations 830. A pressure differential between the perforated zone of the formation and the interior of the casing string 805 can serve to self-activate the controllably activated coating layer and release the metal material to form a solid plug 840 comprising solid metal material to isolate the perforated zone. Solid plug 840 can thus be used for well control by sealing off zones in formation 815. Although not illustrated in FIG. 8, in some cases, when gaps in the annular spacing between the casing string 805 and wellbore 800 are present and in fluid communication with the perforations, the metal material 835 can be forced into the gaps to seal the gaps with solid metal material upon activation of the controllably activated layer.

Figure 9:
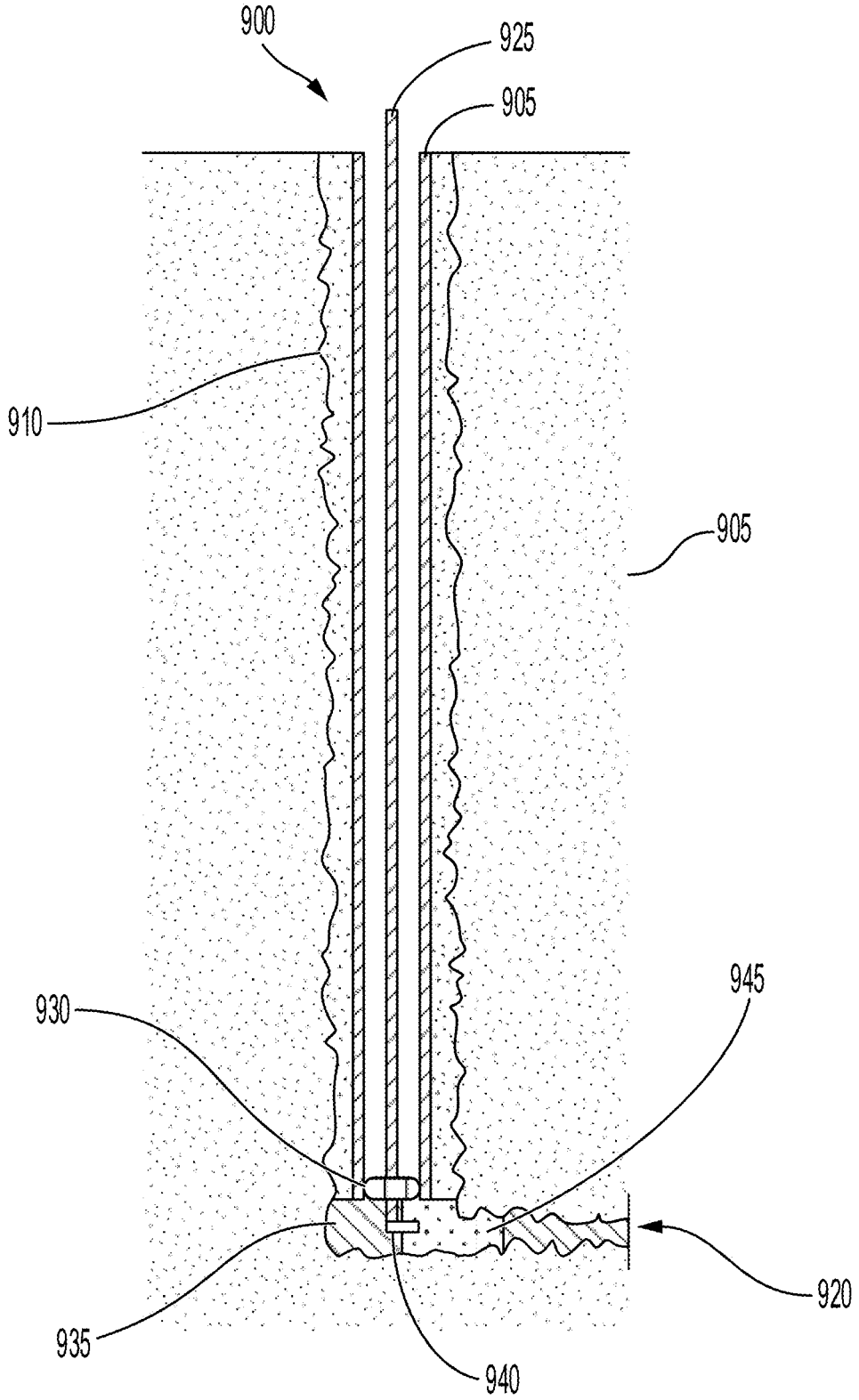
FIG. 9 is a schematic illustration of a wellbore with a loss zone in which a solid metal plug is used for well control according to one example of the present disclosure.

FIG. 9 is a schematic illustration of a wellbore with a loss zone in which a solid metal plug is used for well control according to one example of the present disclosure. FIG. 9 shows a wellbore 900 with a casing string 905 and cement 910 in a formation 915. A loss zone 920 shown downhole in wellbore 900. A wellbore treatment string 925 is shown in wellbore 900 and includes a packer or plug 930 to isolate loss zone 920, though packer or plug 930 is optional. Here, wellbore treatment string 925 delivers metal material 935 having a controllably activated coating layer to bottom of casing string 905 for generating a kill pill to seal loss zone 920 for well control. Wellbore treatment string 925 includes an activation tool 940, such as an ultrasonic transducer, heater, or electromagnet for activating the layer to release metal material to form a solid plug 945 of metal material to isolate the loss zone 920.

In some aspects, mixtures, methods, and materials for wellbore remedial operations are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a method comprising: positioning a metal material in a wellbore, the metal material coated with a layer that is controllably activatable to release the metal material downhole in the wellbore; and activating the layer to release the metal material to perform a remedial wellbore operation that includes plugging a portion of the wellbore using the metal material.

Example 2 is the method of example 1, wherein the metal material is in a liquid state prior to being released downhole in the wellbore, and wherein activating the layer comprises subjecting, at a downhole location, the layer to heat, ultrasonic energy, a magnetic field, an electric field, a compressive stress, a shear stress, or a chemical dissolution treatment to release the metal material in the liquid state into the wellbore at which the metal material changes to a solid state as a plug.

Example 3 is the method of examples 1-2, wherein the remedial wellbore operation comprises (i) patching or repairing a leak in a casing or casing cement in the wellbore with a plug comprising the metal material or (ii) generating an annular barrier comprising the metal material for sealing the portion of the wellbore.

Example 4 is the method of examples 1-3, wherein the remedial wellbore operation comprises (i) filling a perforation or void within a casing, casing cement, or subterranean formation with a plug comprising the metal material or (ii) generating a kill pill comprising the metal material in the wellbore for well control.

Example 5 is the method of examples 1-4, wherein the metal material comprises particles of the metal material in an undercooled liquid state coated with the layer, and wherein the layer comprises one or more of a metal oxide layer, an organic adlayer, an inorganic adlayer, or an organic functional group.

Example 6 is the method of examples 1-5, wherein the metal material comprises Field's metal, Wood's metal, Cerrosafe, Rose's metal, or an alloy or a eutectic alloy of one or more of bismuth, lead, tin, indium, cadmium, thallium, gallium, zinc, copper, silver, gold, or antimony.

Example 7 is a material comprising: a metal material; and a layer coated around the metal material, the layer being controllably activatable in a wellbore to release the metal material to perform a remedial wellbore operation that includes plugging a portion of the wellbore using the metal material.

Example 8 is the material of example 7, wherein the metal material is in a liquid state prior to activation of the layer, and wherein the layer is controllably activatable by subjecting, at a downhole location, the layer to heat, ultrasonic energy, a magnetic field, an electric field, a compressive stress, a shear stress, or a chemical dissolution treatment to release the metal material in the liquid state into the wellbore at which the metal material changes to a solid state as a plug.

Example 9 is the material of examples 7-8, wherein the remedial wellbore operation comprises (i) patching or repairing a leak in a casing or casing cement in the wellbore with a plug comprising the metal material or (ii) generating an annular barrier comprising the metal material for sealing a portion of the wellbore.

Example 10 is the material of example 7-9, wherein the remedial wellbore operation comprises (i) filling a perforation or void within a casing, casing cement, or subterranean formation with a plug comprising the metal material or (ii) generating a kill pill comprising the metal material in the wellbore for well control.

Example 11 is the material of examples 7-10, wherein the metal material comprises particles of the metal material in an undercooled liquid state coated with the layer, and wherein the layer comprises one or more of a metal oxide layer, an organic adlayer, an inorganic adlayer, or an organic functional group.

Example 12 is the material of examples 7-11, wherein the metal material comprises Field's metal, Wood's metal, Cerrosafe, Rose's metal, or an alloy or a eutectic alloy of one or more of bismuth, lead, tin, indium, cadmium, thallium, gallium, zinc, copper, silver, gold, or antimony.

Example 13 is a mixture comprising: a carrier fluid; and a metal material coated with a layer that is controllably activatable in a wellbore to release the metal material to perform a remedial wellbore operation that includes plugging a portion of the wellbore using the metal material.

Example 14 is the mixture of example 13, wherein the metal material is in a liquid state prior to activation of the layer, and wherein the layer is controllably activatable by subjecting, at a downhole location, the layer to heat, ultrasonic energy, a magnetic field, an electric field, a compressive stress, a shear stress, or a chemical dissolution treatment to release the metal material in the liquid state into the wellbore at which the metal material changes to a solid state as a plug.

Example 15 is the mixture of examples 13-14, wherein the remedial wellbore operation comprises patching or repairing a leak in a casing or casing cement in the wellbore with a plug comprising the metal material or generating an annular barrier comprising the metal material for sealing a portion of the wellbore.

Example 16 is the mixture of examples 13-15, wherein the remedial wellbore operation comprises filling a perforation or void within a casing, casing cement, or subterranean formation with a plug comprising the metal material or generating a kill pill comprising the metal material in the wellbore for well control.

Example 17 is the mixture of examples 13-16, wherein the carrier fluid comprises an uncured or liquid cement, an uncured or liquid polymeric material or polymer precursor, an uncured or liquid resin, lost-circulation material, spacer fluid, oil-based mud, or water-based mud.

Example 18 is the mixture of examples 13-17, wherein the metal material comprises particles of the metal material in an undercooled liquid state coated with the layer, and wherein the layer comprises one or more of a metal oxide layer, an organic adlayer, an inorganic adlayer, or an organic functional group.

Example 19 is the mixture of example 18, wherein the particles are suspended or dispersed in the carrier fluid or wherein the particles comprise from 10 wt. % to 90 wt. % of the mixture.

Example 20 is the mixture of examples 13-19, wherein the metal material comprises Field's metal, Wood's metal, Cerrosafe, Rose's metal, an alloy or a eutectic alloy of one or more of bismuth, lead, tin, indium, cadmium, thallium, gallium, zinc, copper, silver, gold, or antimony.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method comprising:

applying particles downhole to a portion of a wellbore, the particles comprising a metal material in an undercooled state coated with a layer that is controllably activatable to release the metal material in a liquid state in the wellbore; and activating the layer to release the metal material in the liquid state from the particles, wherein the metal material in the liquid state fills the portion of the wellbore and solidifies to perform a remedial wellbore operation that includes plugging the portion of the wellbore with a plug comprising the metal material in a solid state.

2. The method of claim 1, wherein activating the layer comprises subjecting, at a downhole location, the particles to ultrasonic energy, a magnetic field, an electric field, a compressive stress, a shear stress, or a chemical dissolution treatment.

3. The method of claim 1, wherein the portion of the wellbore comprises a leak in a casing or casing cement in the wellbore, and wherein the remedial wellbore operation comprises patching or repairing the leak in the casing or casing cement in the wellbore with the plug.

4. The method of claim 1, wherein the portion of the wellbore comprises a perforation or void within a casing or casing cement, and wherein the remedial wellbore operation comprises filling the perforation or void within the casing or casing cement with the plug.

5. The method of claim 1, wherein the layer comprises one or more of a metal oxide layer, an organic adlayer, an inorganic adlayer, or an organic functional group.

6. The method of claim 1, wherein the metal material comprises Field's metal, Wood's metal, Cerrosafe, Rose's metal, or an alloy or a eutectic alloy of one or more of bismuth, lead, tin, indium, cadmium, thallium, gallium, zinc, copper, silver, gold, or antimony.

7. The method of claim 1, wherein activating the layer comprises subjecting, at a downhole location, the particles to heat.

8. The method of claim 1, wherein the particles are suspended or dispersed in a mixture comprising a carrier fluid.

9. The method of claim 8, wherein applying the particles comprises spraying the mixture through a spray nozzle.

10. The method of claim 9, wherein activating the layer occurs by spraying the mixture through the spray nozzle.

11. The method of claim 8, wherein the carrier fluid comprises an uncured or liquid cement, an uncured or liquid polymeric material or polymer precursor, an uncured or liquid resin, lost-circulation material, spacer fluid, oil-based mud, or water-based mud.

12. The method of claim 8, wherein the particles comprise from 10 wt. % to 90 wt. % of a mixture comprising the particles and the carrier fluid.

13. The method of claim 1, wherein the portion of the wellbore comprises a loss zone, and wherein the remedial wellbore operation comprises filling the loss zone with the plug.

14. The method of claim 1, wherein the portion of the wellbore comprises holes in a casing in the wellbore, and wherein the remedial wellbore operation comprises a squeeze job that fills the holes in the casing to create a solid metal seal in an annulus between the casing and the wellbore, the solid metal seal comprising the plug.

15. The method of claim 1, wherein the remedial wellbore operation comprises generating an annular barrier, the annular barrier lining a circumference of a casing in the wellbore or positioned in an annular spacing between the casing and the wellbore.

16. The method of claim 1, wherein the portion of the wellbore is a bottom of a casing string in the wellbore, and wherein the remedial wellbore operation comprises plugging the bottom of the casing string with a kill pill comprising the plug.

17. The method of claim 1, wherein the portion of the wellbore comprises a perforation within a subterranean formation adjacent to the wellbore, and wherein the remedial wellbore operation comprises filling the perforation with the plug to seal the perforation and seal a zone in the subterranean formation.

18. The method of claim 1, further comprising positioning an activation tool downhole in the wellbore for activating the layer, and wherein activating the layer comprises using the activation tool.

19. The method of claim 18, wherein the activation tool comprises one or more of an ultrasonic transducer, a heater, or an electromagnet.

20. The method of claim 1, wherein applying the particles to the portion of the wellbore comprises applying the particles onto a damaged or leaking portion of a casing or casing cement in the wellbore, and wherein the remedial wellbore operation comprises repairing a leak in the wellbore or sealing damage in the wellbore.

* * * * *